US006898887B1

(12) United States Patent
Stratbucker

(10) Patent No.: US 6,898,887 B1
(45) Date of Patent: May 31, 2005

(54) SAFE AND EFFICIENT ELECTRICALLY BASED INTENTIONAL INCAPACITATION DEVICE COMPRISING BIOFEEDBACK MEANS TO IMPROVE PERFORMANCE AND LOWER RISK TO SUBJECTS

(75) Inventor: Robert A. Stratbucker, Omaha, NE (US)

(73) Assignee: Taser International Inc., Scottsdale, AZ (US)

( * ) Notice: Subject to any disclaimer, the term of this patent is extended or adjusted under 35 U.S.C. 154(b) by 0 days.

(21) Appl. No.: 10/631,683

(22) Filed: Jul. 30, 2003

Related U.S. Application Data

(60) Provisional application No. 60/399,643, filed on Jul. 31, 2002, now abandoned.

(51) Int. Cl.[7] ..... F41C 9/00
(52) U.S. Cl. ..... 42/1.08; 42/84; 89/1.11
(58) Field of Search ..... 42/84; 89/1.11, 89/1.08

(56) References Cited

U.S. PATENT DOCUMENTS

| | | | | | |
|---|---|---|---|---|---|
| 3,803,463 | A | * | 4/1974 | Cover | 361/232 |
| 3,971,292 | A | * | 7/1976 | Paniagua | 89/1.11 |
| 4,852,454 | A | * | 8/1989 | Batchelder | 89/1.11 |
| 4,884,809 | A | | 12/1989 | Rowan | 463/47.3 |
| 5,654,867 | A | | 8/1997 | Murray | 361/232 |
| 5,831,199 | A | | 11/1998 | McNulty, Jr. et al. | 89/1.11 |
| 5,962,806 | A | * | 10/1999 | Coakley et al. | 102/502 |
| 6,636,412 | B2 | * | 10/2003 | Smith | 361/232 |
| 2001/0012918 | A1 | | 8/2001 | Swanson | |

* cited by examiner

*Primary Examiner*—Stephen M. Johnson
(74) *Attorney, Agent, or Firm*—James D. Welch

(57) ABSTRACT

Disclosed is a system and method providing immediate monitoring of physiological parameters, such as cardiac function, during or after application of electric shock to temporarily incapacitate a subject via at least one electrode ballistically implanted into the subject's skin, including altering of energy characterized parameters based upon said monitored physiological parameters.

13 Claims, 1 Drawing Sheet

SAFE AND EFFICIENT ELECTRICALLY BASED INTENTIONAL INCAPACITATION DEVICE COMPRISING BIOFEEDBACK MEANS TO IMPROVE PERFORMANCE AND LOWER RISK TO SUBJECTS

This Application Claims Benefit of Provisional Application Ser. No. 60/399,643 Filed Jul. 31, 2002.

TECHNICAL FIELD

The disclosed invention pertains to monitoring of physiological function in subjects, and more particularly to system and method enabling immediate monitoring of physiologic function of a subject after application of electric shock thereto via at least one electrode ballistically implanted thereinto, including data storage means and the capability to alter characterizing parameters of follow-on electric shocks to lessen risk of injury to said subject.

BACKGROUND

Electro-immobilization devices, such as TASERS, ("TASER" is a Registered Trademark), and Stun Guns, deliver electric shocks to subjects, and use thereof by security personnel to control recalcitrant persons is becoming more and more common. Recently, however, question has been raised about the effect of the delivery of an electric shock thereto, on a receiving person's cardiac function. For instance, speculation that cardiac function was disrupted by application of an electric shock, as determined at a later time has recently increased. It would therefore provide utility if substantially simultaneously, or at a some relatively short time delay after delivery of a shock to a subject, physiological function(s) of said subject could be monitored and documented in a storage media.

With the disclosed invention in mind a Search for Patents was conducted. Identified were:

U.S. Pat. No. 5,831,199 to McNulty et al. which describes a Weapon for Immobilization and Capture;

U.S. Pat. No. 5,654,867 to Murray which describes an Immobilization Weapon;

U.S. Pat. No. 4,884,809 to Rowan which describes an Interaction Transector Device which provides for ECG monitoring; and Published patent application Ser. No. 2001/0012918 by Swanson which describes utilizing electrical energy pulses to temporarily stun a zone of tissue. Monitoring ECG's is mentioned.

There is identified a need for system and method for applying temporarily incapacitating electric shocks via ballistically implanted electrode(s), and simultaneously or after a short period, monitoring physiological parameters via the same electrodes, then using said monitored physiological parameters to altering characterizing parameters of follow-on temporarily incapacitating electric shocks administered to said subject for the purpose of lessening risk of injury to said subject.

DISCLOSURE OF THE INVENTION

The disclosed invention comprises both system and method for enabling both immediate monitoring of stimulus-shock modulated physiologic functions such as ECG and Fibrillation threshold as well as assessment of stimulus-shock modulated biophysical parameters such as specific conductance and electrode impedance, said functions and parameters having been perturbed from normal by imposition of complex time variant electric fields on nerves, muscles and other sensitive body tissues in the vicinity of one or more ballistically impressed or implanted body surface electrodes. Further, the disclosed invention includes constructive use of said functions and parameters in electronic tailoring of stimulus-shock waveforms to optimize system performance during intentional electrical incapacitation of subjects while concomitantly minimizing the risk of untoward outcomes of such efforts. That is, based upon the results of monitoring physiological parameters of a subject after delivery of an electric shock thereto for the purpose of temporarily incapacitating him or her, the characterizing parameters, (eg. frequency, duty cycle, pulse energy content, pulse patterns and the like), of follow-on electric shocks can be altered to lessen risk of injury to said subject, such as cardiac malfunction.

As a particularly relevant example, TASERS (Registered Trademark), are identified as known systems which deliver electric shock to subjects via ballistically implanted, (preferably into the subject's skin), tethered electrodes. The disclosed invention is to substantially simultaneously, or after some small time delay, use the circuit provided by such implanted electrodes to monitor and store ECG function, via circuitry which is functionally integrated into the electric shock deliver system.

The disclosed invention is then a system for delivery of an electric shock to a subject via at least one electrode implanted thereinto, comprising means for monitoring physiological function of said subject via said at least one electrode.

A typical monitored physiological function is cardiac ECG data, and it is monitored via at least one electrode which is ballistically implanted into said subject by a TASER system.

A particularly relevant embodiment of the disclosed invention is a TASER system for delivery of a temporarily incapacitating electric shock to a subject via at least one electrode ballistically implanted thereinto thereby. Said system further comprises means for monitoring ECG data via said at least one ballistically implanted tethered electrode, and further comprises means for altering the characterizing parameters of follow-on temporarily incapacitating electric shocks administered to said subject to lessen risk of injury to said subject. Said alteration is based on the monitored ECG data of said subject during or after delivery of an electric shock thereto. Said TASER System further comprises storage means for recording data pertaining to monitored ECG of said subject obtained via said at least one ballistically implanted electrode.

A method of providing record of a subject's physiological function substantially simultaneously with, or after a short time delay after delivery of an electric shock thereto, comprising the steps of:

a) providing a system for delivery of an electric shock to a subject via at least one electrode implanted thereinto, comprising means for monitoring physiological function of said subject via said at least one electrode;

b) causing said system to implant at least one electrode onto a subject;

c) substantially simultaneously with, or after a short time delay after delivery of an electric shock by said system to said subject, utilizing the circuit established by said at least one implanted electrode to monitor physiological function of said subject.

Said method can further comprise storage of the physiological data monitored in memory means integrated into said system, and a particularly relevant embodiment involves using a TASER system to implant the at least one electrode into said subject ballistically. Further, said TASER system comprises means for altering the characterizing parameters of follow-on electric shocks to lessen risk of injury to said subject based on monitored physiological parameters of said subject during or after delivery of an electric shock thereto, and means which records data pertaining to monitoring physiological function of said subject obtained via said at least one ballistically implanted electrode.

A disclosed method of temporarily incapacitating a subject comprises the steps of:

a) providing a TASER system for delivery of a temporarily incapacitating electric shock to a subject via at least one tethered electrode ballistically implanted thereinto thereby, said system further comprising means for monitoring ECG data via said at least one ballistically implanted tethered electrode; said TASER system further comprising means for altering the characterizing parameters of follow-on temporarily incapacitating electric shocks administered to said subject to lessen risk of injury to said subject based on the monitored ECG data of said subject during or after delivery of an electric shock thereto;

b) causing said TASER system to ballistically implant at least one tethered electrode onto a subject;

c) substantially simultaneously with, or after a short time delay after delivery of an electric shock by said TASER system to said subject, utilizing the circuit established by said at least one implanted tethered electrode to monitor ECG data of said subject;

d) based upon the monitored ECG data causing said means for altering the characterizing parameters of follow-on temporarily incapacitating electric shocks administered to said subject to alter characterizing parameters of follow-on temporarily incapacitating electric shocks administered to said subject to lessen risk of injury to said subject.

Said method preferably further comprises providing a storage means in said TASER system for recording ECG data, and causing it to record monitored subject ECG data.

It is to be understood that the terminology "at least one electrode" is used as while typically two electrode will be implanted into a subject, it is possible for one electrode to be implanted in a subject and a ground path serve as a circuit completing pathway.

The terminology "tethered" is to be understood to mean that ballistically implanted TASER electrodes are attached to a TASER body from which they were ejected, and typically comprises electrically conductive means such as wires.

It is also clarified that the terminology "implanted" is to be interpreted in a functional sense. That is, while an electrode implanted in a subject's skin is preferred, it is possible that implantation in clothing can be sufficient to apply an electrical shock and to, and monitor physiological function of a subject.

The disclosed invention will be better understood by reference to the Detailed description Section of this Specification with the Drawings.

SUMMARY

It is therefore a primary purpose and/or objective of the disclosed invention to teach monitoring of an ECG of a subject during or after application of an electric shock thereto, wherein the same electrode(s) utilized to deliver said electric shock are utilized to monitor said ECG.

It is a specific purpose and/or objective of the disclosed invention to teach monitoring of an ECG of a subject during or after application of an electric shock thereto by a TASER, wherein the same electrode(s) utilized to deliver said electric shock are utilized to monitor said ECG.

It is yet a specific purpose and/or objective of the disclosed invention to teach monitoring of physiological parameter(s) of a subject during or after application of an electric shock thereto by a TASER, wherein the same electrode(s) utilized to deliver said electric shock are utilized to monitor said ECG, and wherein characterizing parameters, (eg. frequency, duty cycle, pulse energy content, pulse patterns and the like), of follow-on applied electrical energy determined necessary to effect temporarily incapacitate a subject are altered on the basis of said monitored physiological parameters so as to lessen the risk of injury to the subject.

Additional purposes and/or objectives of the disclosed invention will be apparent from a reading of the Specification and Claims.

DETAILED DESCRIPTION

Figure 1:
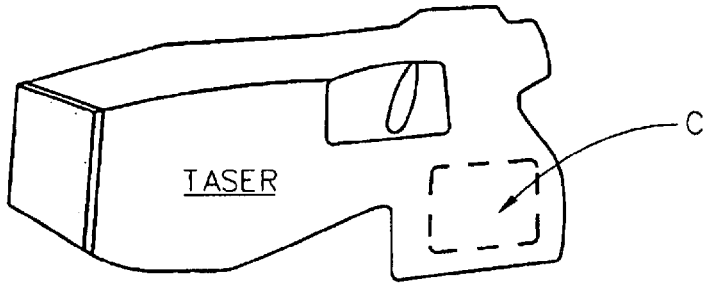
FIG. 1 provides a representation a TASER system.
Figure 2:
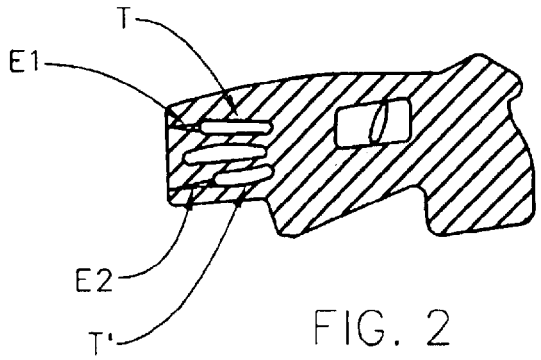
FIG. 2 shows a TASER system contains Electrodes (E1) and (E2) and Tethering (T).
Figure 3:
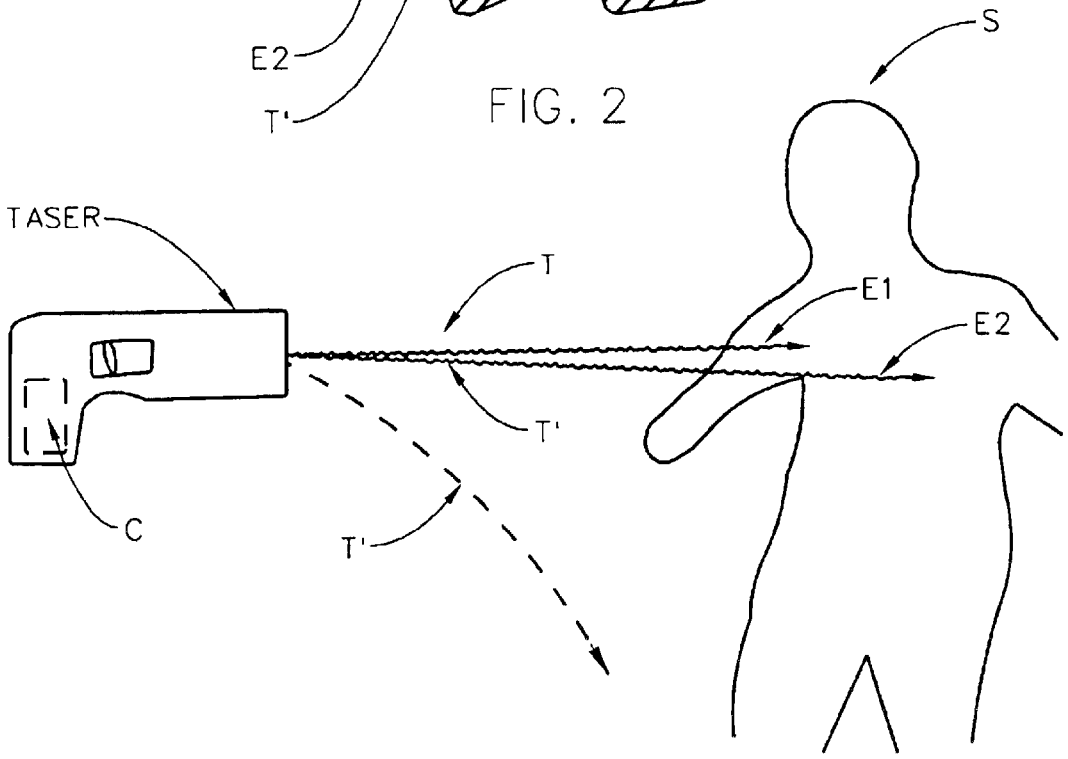
FIG. 3 shows a TASER system applied to temporarily incapacitate a Subject (S).

Turning now to the Drawings, it should be appreciated that FIG. 1 provides a representation a TASER system. Not specifically shown but understood as present are Electrodes and Propelling means therefore. FIG. 2 indicates that inside the TASER system are present Electrodes (E1) (E2) with Tether Wiring (T) (T'). FIG. 3 shows a TASER system ballistically applied to temporarily incapacitate a Subject (S). Note that the Tether Wiring (T) (T') wires connect the TASER to the Electrodes (E1) and (E2). Note that (C) indicates Circuitry in the TASER in FIGS. 1 and 3. Said circuitry enables providing electric shock, and receives signals that monitor physiological function of said subject via said at least one Electrode. Circuitry (C) also provides means for, on the basis of monitored physiological parameters, after deliver of a first electric shock, altering the characterizing parameters of follow-on electric shocks to lessen risk of injury to said subject, based on monitored physiological parameters of said subject during, or after, delivery of an electric shock thereto. Circuitry (C) also comprises storage means which records data pertaining to monitoring physiological function of said subject obtained via said at least one ballistically implanted electrode.

It is specifically noted that Circuitry (C) indicated in FIGS. 1 and 3 comprises:

means for monitoring physiological function;

means for monitoring ECG data;

means for atering characterizing parameters;

storage means which records data.

Note that Tether wiring (T') can implant in the ground and the system still work, although preference is that both Electrodes (E1) and (E2) implant into the Subject.

Having hereby disclosed the subject matter of the present invention, it should be obvious that many modifications, substitutions, and variations of the present invention are possible in view of the teachings. It is therefore to be understood that the invention may be practiced other than as specifically described, and should be limited in its breadth and scope only by the Claims.

I claim:

1. A system for delivery of an electric shock to a subject via at least one electrode ballistically implanted thereinto, said system further comprising means for monitoring physiological function of said subject via said at least one electrode.

2. A system as in claim 1, in which the physiological function monitored is cardiac function in the form of ECG data.

3. A system as in claim 1, in which said at least one electrode is ballistically implanted into said subject by a TASER system for application in temporarily incapacitating a said subject.

4. A system as in claim 3, in which said TASER system comprises means for altering the characterizing parameters of follow-on electric shocks to lessen risk of injury to said subject based on monitored physiological parameters of said subject during or after delivery of an electric shock thereto.

5. A system as in claim 1, which further comprises storage means which records data pertaining to monitoring physiological function of said subject obtained via said at least one ballistically implanted electrode.

6. A TASER system for delivery of a temporarily incapacitating electric shock to a subject via at least one tethered electrode ballistically implanted thereinto thereby, said system further comprising means for monitoring ECG data via said at least one ballistically implanted tethered electrode; said TASER system further comprising means for altering the characterizing parameters of follow-on temporarily incapacitating electric shocks administered to said subject to lessen risk of injury to said subject, said alteration being based on the monitored ECG data of said subject during or after delivery of an electric shock thereto, and said TASER System further comprising storage means for recording data pertaining to said monitored ECG of said subject obtained via said at least one ballistically implanted electrode.

7. A method of providing record of a subject's physiological function substantially simultaneously with, or after a short time delay after delivery of an electric shock thereto, comprising the steps of:

a) providing a system for delivery of said electric shock to said subject via at least one electrode implanted thereinto, comprising means for monitoring physiological function of said subject via said at least one electrode;

b) causing said system to implant at least one electrode onto said a subject;

c) substantially simultaneously with, or after said short time delay after delivery of said electric shock by said system to said subject, utilizing the circuit established by said at least one implanted electrode to monitor physiological function of said subject.

8. A method as in claim 7, which further comprises storage of physiological data monitored in memory means integrated into said system.

9. A method as in claim 7 in which the step of providing a system involves providing a TASER which implants the at least one electrode into said subject ballistically.

10. A method as in claim 9 in which the step of providing a system involves providing a said TASER which comprises means for altering the characterizing parameters of follow-on electric shocks to lessen risk of injury to said subject based on monitored physiological parameters of said subject during or after delivery of said electric shock thereto.

11. A method as in claim 9 in which the step of providing a system involves providing a said TASER which comprises means which records data pertaining to monitoring physiological function of said subject obtained via said at least one ballistically implanted electrode.

12. A method of temporarily incapacitating a subject comprising the steps of:

a) providing a TASER system for delivery of a temporarily incapacitating electric shock to a subject via at least one tethered electrode ballistically implanted thereinto thereby, said system further comprising means for monitoring ECG data via said at least one ballistically implanted tethered electrode; said TASER system further comprising means for altering the characterizing parameters of follow-on temporarily incapacitating electric shocks administered to said subject to lessen risk of injury to said subject based on the monitored ECG data of said subject during or after delivery of said electric shock thereto;

b) causing said TASER system to ballistically implant said at least one tethered electrode onto said subject;

c) substantially simultaneously with, or after a short time delay after delivery of said electric shock by said TASER system to said subject, utilizing the circuit established by said at least one implanted electrode to monitor ECG data of said subject;

d) based upon the monitored ECG data causing said means for altering the characterizing parameters of follow-on temporarily incapacitating electric shocks administered to said subject to alter characterizing parameters of follow-on temporarily incapacitating electric shocks administered to said subject to lessen risk of injury to said subject.

13. A method of temporarily incapacitating a subject as in claim 12 which further comprises providing a storage means in said TASER system for recording ECG data, and causing said storage means to record monitored subject ECG data.

* * * * *